US005893414A

United States Patent [19]

Shaposhnikov et al.

[11] Patent Number: 5,893,414

[45] Date of Patent: Apr. 13, 1999

[54] DEVICE FOR INTENSIFICATION OF HYDROCARBON PRODUCTION AND HYDROCARBONS PRODUCTION SYSTEM

[75] Inventors: Vladimir M. Shaposhnikov; Leonid A. Kuslitskiy, both of Brooklyn, N.Y.

[73] Assignee: Petroenergy LLC, New York, N.Y.

[21] Appl. No.: 09/071,847

[22] Filed: May 2, 1998

[51] Int. Cl.[6] ..... E21B 23/00; E21B 23/02; E21B 33/129

[52] U.S. Cl. ..... 166/191; 166/242.1; 166/242.6; 166/217; 166/370

[58] Field of Search ..... 166/242.1, 242.6, 166/222, 191, 217, 369, 370, 372

[56] References Cited

U.S. PATENT DOCUMENTS

| | | | |
|---|---|---|---|
| 2,649,914 | 8/1953 | Otis | 166/217 X |
| 3,987,847 | 10/1976 | Craig | 166/191 |
| 4,444,253 | 4/1984 | Smith et al. | 166/191 |
| 4,605,069 | 8/1986 | McClaflin et al. | 166/310 |
| 5,105,889 | 4/1992 | Misikov et al. | 166/372 |
| 5,697,448 | 12/1997 | Johnson | 166/369 |
| 5,752,570 | 5/1998 | Shaposhnikov | 166/372 |

*Primary Examiner*—George Suchfield
*Attorney, Agent, or Firm*—Ilya Zborovsky

[57] ABSTRACT

A device for intensification of hydrocarbons production has a substantially tubular hollow body adapted to be arranged inside a well tubing and having an axis and a plurality of passages arranged one after the other in an axial direction and having different dimensions so that hydrocarbons can flow from a bottomhole of the well successively through the passages toward a well head, the body having at least one tubular portion which is provided inside with at least one of the passages and is provided outside with a unit for fixing the at least one portion and therefore the body to the well tubing, the body also having another portion axially spaced from at least one portion and provided inside with at least one of the passages and outside with a unit for sealing the another portion relative to the well tubing.

19 Claims, 3 Drawing Sheets

DEVICE FOR INTENSIFICATION OF HYDROCARBON PRODUCTION AND HYDROCARBONS PRODUCTION SYSTEM

BACKGROUND OF THE INVENTION

The present invention relates to a device for intensification of production of hydrocarbons, such as for example oil production, as well as to a hydrocarbon production system provided therewith.

A device for intensification of hydrocarbons production is disclosed in U.S. Pat. No. 5,105,889. The device includes a body hermetically fixed in a tubing through a landing seat, an inlet nozzle, a collet and Venturi tubes assembled successively one after the other inside the body. In this device gas which is dissolved in the formation fluid is forced out, and a flow of hydrocarbons exiting from the nozzle is converted into dispersed gas-fluid flow. The above described device provides a substantial intensification of hydrocarbons production. On the other hand, it has some disadvantages. The special landing seat is needed for each well and is to be adapted for each particular device, so that for installation of removal of the seat lifting and lowering of the whole tubing is needed, which naturally involves additional time, labor and expenses. The landing seat decreases a cross-section of the bottomhole of the well posing substantial difficulties when it is necessary to perform other procedures, for example measuring. The landing seat can be connected only at one piece of the tubing which is at the bottomhole of the well. In the known device rubber O-rings are provide between the device and the landing seat to ensure hermetic stability. They cause some difficulties when the device is installed and they are not completely reliable. The elastic fixing element of the device formed as a collet which is located downstream of the device is susceptible to mechanical fractures and other defects, which decrease the service life and reliability of the whole device. The collet must be destroyed when the device is lifted from the well and its parts are left in the bottomhole and pollute the latter. In the event of extensive exploitation in corrosive areas of the well bottomhole, the properties of the collet material change and stability can be lost. As a result, lifting of the device to the surface with conventional equipment can be impossible and the well in this situation is completely incapacitated. The device can not be used in the hydrocarbons well with a multi-purpose nipple at the bottomhole for installation and removal of different well devices and measuring equipment. The specific design features such as the lower fastening, the presence of collet, etc. limits the possibility of necessary variations with use of the Venturi tubes.

SUMMARY OF THE INVENTION

Accordingly, it is an object of present invention to provide a device for intensification of hydrocarbons production which avoids the disadvantages of the prior art.

More particularly, it is an object of present invention to provide a device for intensification of hydrocarbons production, which ensures efficient lifting, lowering, prolongation of service life, and exploitation in the well.

In keeping with these objects and with others which will become apparent hereinafter, one feature of present invention resides, briefly stated, in a device for intensification of hydrocarbons production which comprises a substantially tubular body adapted to be arranged inside a well tubing and having an axis and a plurality of passages arranged one after the other in an axial direction and having different diameters, so that hydrocarbons can flow from a bottomhole of the well successively through said passages toward a wellhead, the body having at least a tubular portion which is provided inside with at least one of the passages and is provided outside with means for fixing the one portion and therefore the body to the well tubing, the body also having another portion axially spaced from at least one portion and provided inside with at least one of the passages and outside with means for sealing the another portion relative to the well tubing.

It is another object of present invention to provide a system for hydrocarbons production which comprises a well tubing; and a device for intensification of hydrocarbons production, the device including a substantially tubular body adapted to be arranged inside a well tubing and having an axis and a plurality of passages arranged one after the other in an axial direction and having different diameters so that hydrocarbons can flow from a bottomhole of the well successively through the passages toward a well head, the body having at least a tubular portion which is provided inside with at least one of the passages and is provided outside with means for fixing the at least one portion and therefore the body to the well tubing, the body also having another portion axially spaced from at least one portion and provided inside with at least one of the passages and outside with means for sealing the another portion relative to the well tubing.

When the device for intensification of hydrocarbons production and the system for hydrocarbons production are designed in accordance with the present invention, they eliminate the disadvantages of the prior art and provide for the above mentioned highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
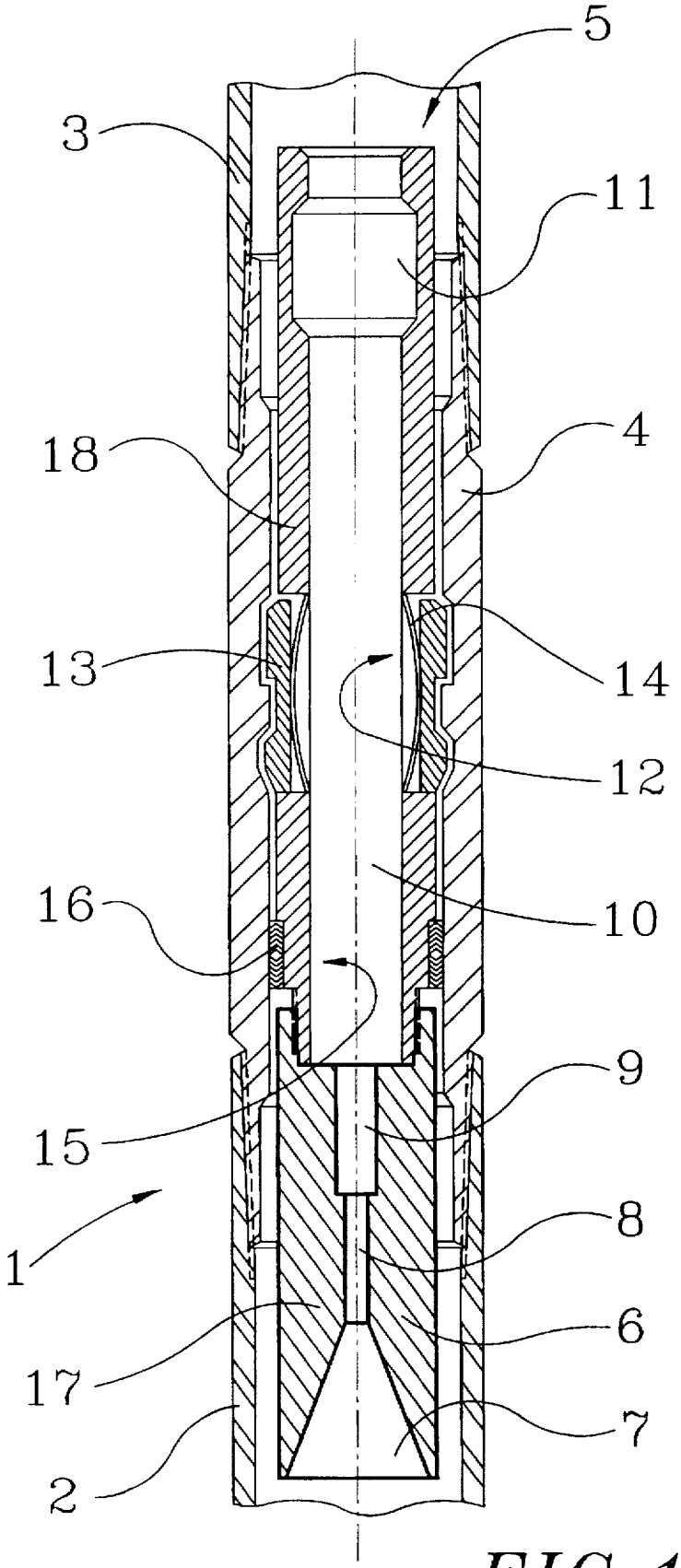
FIG. 1 is a view schematically showing a device for intensification of hydrocarbons production which is formed in accordance with one embodiment of the present invention and arranged in a well tubing provided with a nipple.

A device for intensification of production of hydrocarbons, in particular hydrocarbons production shown in FIG. 1 is arranged in a well tubing which is identified as a whole with reference numeral 1. The well tubing 1 includes a lower or upstream tubing part 2 and an upper or downstream tubing part 3 as considered in a direction of flow of hydrocarbons from a bottomhole to a wellhead. The tubing parts 2 and 3 are spaced from one another and connected by a nipple 4. The connection can be performed for example by threads shown in the drawing.

The device for intensification of hydrocarbons production is identified as a whole with reference numeral 5. It has a hollow body 6 which forms inside a composite flow passage through which hydrocarbons flows from a bottomhole of the well toward a well head. The composite passage includes a nozzle 7 provided at a lower or inlet end of the body 6, a first passage 8 communicating with the nozzle 7, a second passage 9 communicating with the first passage 8, and a third passage 10 communicating with the second passage 9. At the upper end of the third passage 10, an opening 11 for a not shown lifting tool can be provided. As can be seen from the drawings, in the shown embodiment the diameters of the passages 8, 9, and 10 increase in the direction of hydrocarbons flow. The dimensions of the nozzle 7 and the tubes 8, 9, 10 are specifically selected to provide intensification of the hydrocarbons production as disclosed in detail in the above mentioned U.S. Pat. No. 5,105,889 which is incorporated here by means of a reference.

The device 5 has a portion which is identified with reference numeral 12. This portion at its inner side forms a part of the third passage 10, and is provided on an outer side with means for fixing the portion 12 to the nipple 4. In the shown embodiment the fixing means include a plurality of keys 13 arranged in radial slots of the portion 12 and spring-biased radially outwardly by springs 14. The keys 13 are provided with projections engageable in corresponding grooves formed in the inner surface of the nipple 4. In the shown fixed position of the device, the springs 14 urge the keys 13 radially outwardly, so that the projections of the keys 13 engage in the grooves of the nipple 4, and the device is reliably retained in the nipple. When it is necessary to remove device from the tubing, the above mentioned lifting tool engages in the opening 11, and pulls the device vertically upwardly. Due to the inclined flanks on the projections of the keys 13 and in the grooves of the nipple 4, the keys 13 are displaced radially inwardly, and the device can be withdrawn from the tubing.

The device further has another portion which is identified with reference numeral 15. The portion 15 at an inner side forms a part of the third passage 10 and on the outer side is provided with a sealing element 16. The sealing element 16 can be arranged in a groove formed in the outer surface of the portion 15. It reliably seals the portion 15 and therefore the device relative to the nipple 4. During the withdrawal of the device from the tubing, the lifting tool overcomes the frictional contact of the outer surface of the sealing element 16 with the inner wall of the nipple 4.

As can be seen from the drawing, the body 6 is composed of two body parts 17 and 18 located one after the other in the direction of flow of hydrocarbons. In the shown embodiment, the body part 18 as a whole forms the entire third passage 10 at an inner side and is provided with the fixing means 13 and the sealing means 16 on the outer side. The nozzle 7, the first tube 8, and the second tube 9 are formed in the first body part 17. The body part 17 and 18 are connected with one another for example by a thread.

Figure 2:
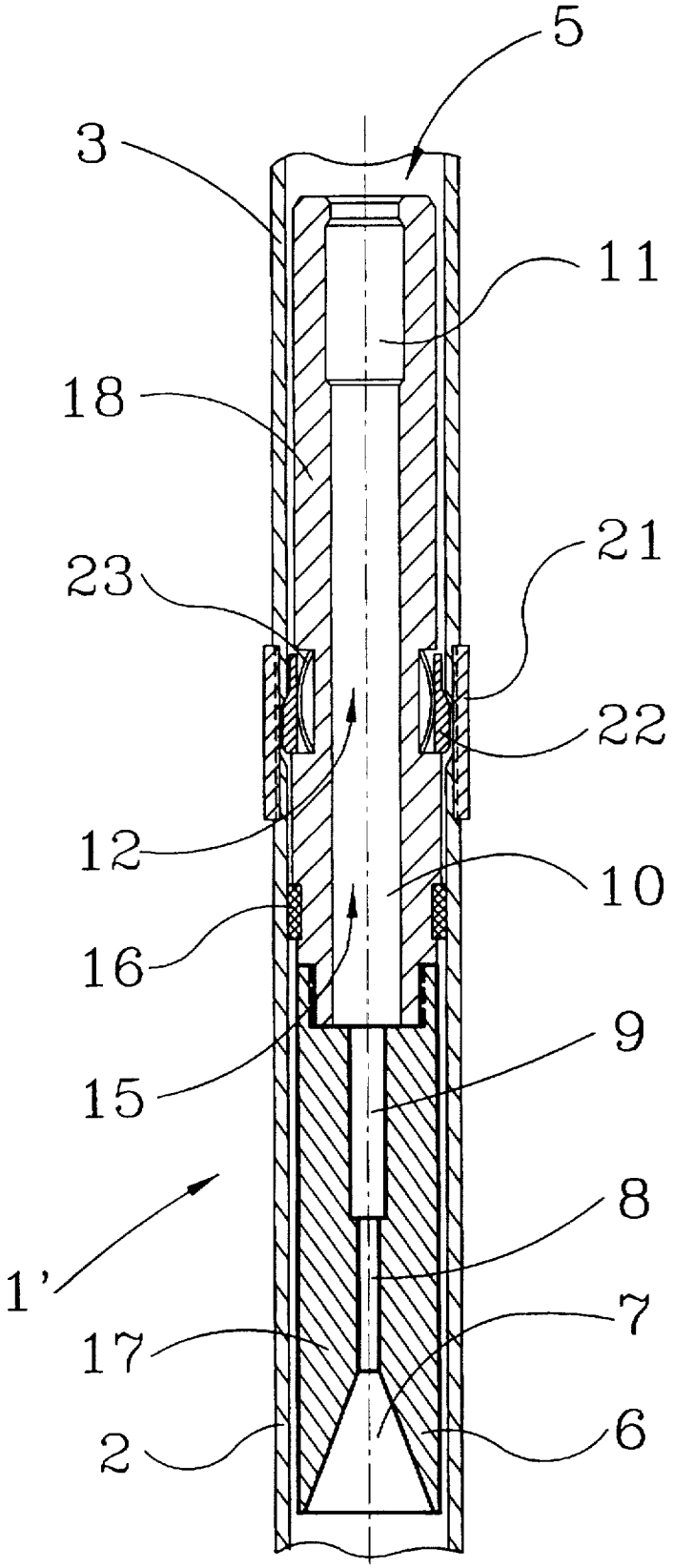
FIG. 2 is a view showing a device for intensification of hydrocarbons production which is formed in accordance with another embodiment of the present invention and installed in a well tubing provided with a tubing collar.

FIG. 2 is a view showing a device for intensification of hydrocarbons production in accordance with a second embodiment of the present invention. The device 5 of FIG. 2 is arranged in a well tubing 1' which includes a lower or upstream tubing part 2, an upper or downstream tubing part 3, and a collar 21 which connects the tubing parts 2 and 3 with one another. The connection can be formed for example by threads as shown in the drawings. The device also has the body 6 provided with the nozzle 7 and the passages 8, 9, 10. In this embodiment, the portion 12 of the body 6 at an inner side forms a part of the third passage 10 and on an outer side is provided with fixing means, while the portion 15 of the body 6 at an inner side forms a part of the passage 10 and at an outer side is provided with sealing means 16. The fixing means is however somewhat different. The fixing means or keys include a plurality of locating and locking dogs 22 which in an operative position are pressed radially outwardly by flat springs 23 and have outer projections engaging in inner grooves of the collar 21. The outer projections of the locking dogs 22 and the inner grooves of the collar 21 have an upper inclined flank to allow a withdrawal of the device when the lifting element engaging in the opening 11 pulls the device upwardly.

Figure 3:
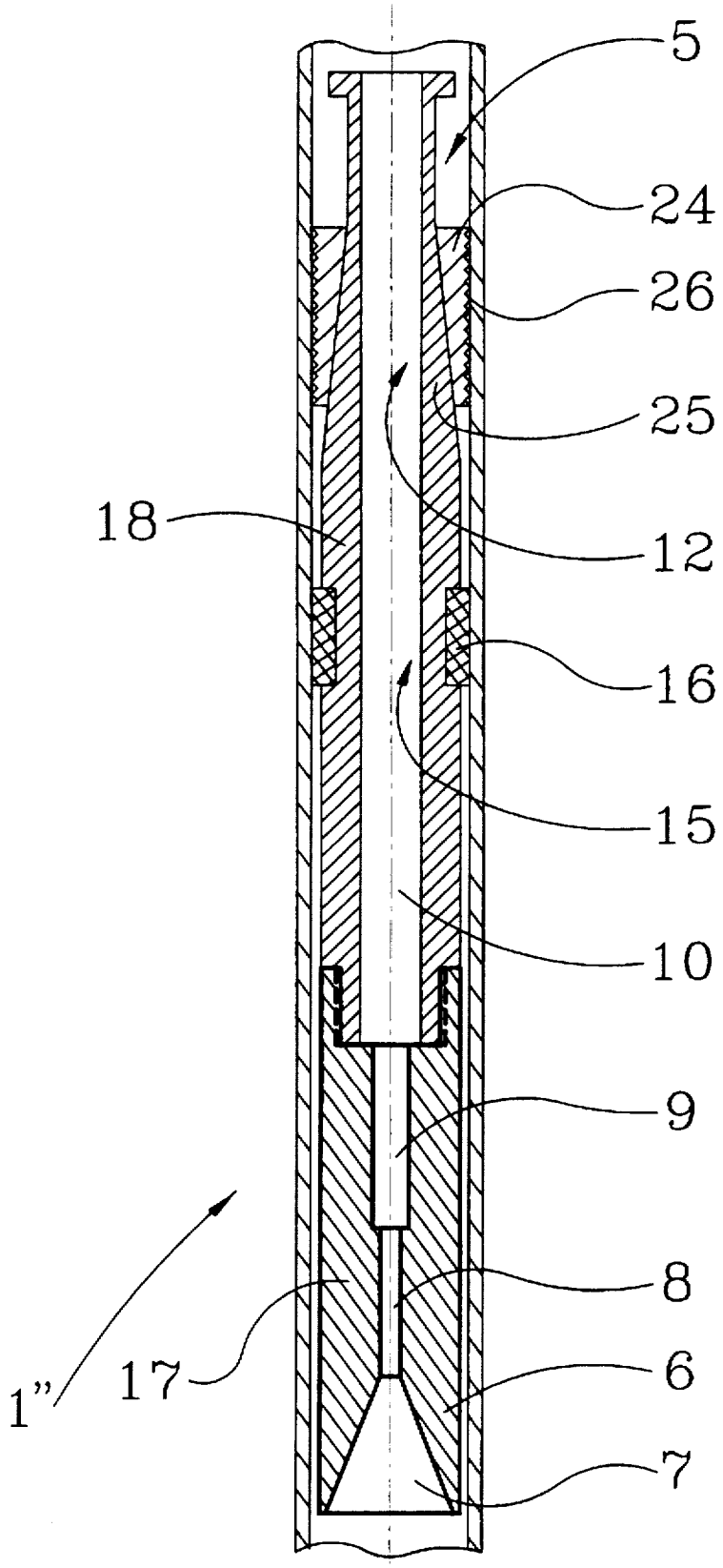
FIG. 3 is a view showing a device for intensification of hydrocarbons production which is formed in accordance with a third embodiment of the present invention and arranged in a smooth well tubing without a tubing nipple or a tubing collar.

A device for intensification of hydrocarbons production in accordance with a third embodiment of the present invention shown in FIG. 3 is arranged in an integral well tubing 1" having a smooth inner surface. The device also has the body 6 provided with the nozzle 7 and the passages 8, 9, 10. One portion 12 of the device 5 has an inner side forming a part of the third passage 10 and an outer side provided with fixing means and another portion 15 having an inner side forming a part of the third passage 10 and an outer side provided with sealing means 16. The fixing means include a plurality of locking members 24 which are spaced from one another in a circumferential direction and have an inner inclined surface. A corresponding part of the outer surface of the portion 12 of the body 6 has also an inclined surface corresponding to the inclined surface of the locking members 24. While the conical surface 25 is provided on an inner surface of each locking member 24 its outer surface is provided with a plurality of engaging formations which can be formed for example as small teeth. In the position shown in FIG. 3, the device is displaced slightly upwardly, so that the outer conical surface of the portion 12 spreads radially outwardly the locking members 24. As a result, the outer formations 26 engage forceably with the inner surface of the well tubing 1" and fix the device in the well tubing. When it is necessary to withdraw the device from the well tubing, the device is displaced first downwardly, the inner inclined surfaces 25 of the fixing members 24 loose their radially inner support, and the locking members 24 are displaced radially inwardly. Now, the device can be withdrawn from the well tubing.

It will be understood that each of the elements described above, or two or more together, may also find a useful application in other types of constructions differing from the types described above.

While the invention has been illustrated and described as embodied in device for intensification of hydrocarbons production, and hydrocarbons production system provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for intensification of oil production, comprising a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a nipple located between the tubing parts and connecting the tubing parts with one another, said fixing means being formed so as to fix said at lest one portion of said body to the nipple.

2. A device as defined in claim 1, wherein said other portion of said body is located upstream of said one portion as considered in a direction of flow of hydrocarbons through said passages of said body.

3. A device as defined in claim 1, wherein said body is composed of at least two body parts including a first body part located upstream of a second body part as considered in a direction of flow of hydrocarbons through said passages of said body, said fixing means and said sealing means being provided in said second body part.

4. A device as defined in claim 3; and further comprising means for releasably connecting said first and second body parts with one another.

5. A device for intensification of oil production, comprising a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a nipple located between the tubing parts and connecting the tubing parts with one another, said fixing means being formed so as to fix said at lest one portion of said body to the nipple, and said sealing means being formed so as to seal said at least one portion of said body relative to the nipple.

6. A device for intensification of oil production, comprising a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a collar connecting the tubing parts with one another, said fixing means of said at least one portion of said body being formed so as to fix said one portion relative to the collar.

7. A device for intensification of oil production, comprising a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a collar connecting the tubing parts with one another, said fixing means of said at least one portion of said body being formed so as to fix said one portion relative to the collar, said sealing means being formed so as to seal said at least one portion of said body relative to said well tubing.

8. A device for intensification of oil production, comprising a substantially tubular hollow body adapted to be arranged inside a well tubing with a smooth inner surface and having an axis and a plurality of passages arranged one after the other in an axial direction and having different dimensions so that oil can flow from a bottomhole of the well successively through said passages toward a well head, said body having at least one portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, said fixing means being formed so as to fix said at least one portion of said body to the smooth inner surface of the well tubing, said sealing means being formed so as to seal said at least one portion of said body relative to the smooth inner surface of the well tubing.

9. An oil production system, comprising a well tubing; and a device for intensification of oil production, said device including a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one tubular portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a nipple located between the tubing parts and connecting the tubing parts with one another, said fixing means being formed so as to fix said at least one portion of said body to the nipple.

10. An oil production system, comprising a well tubing; and a device for intensification of oil production, said device including a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one tubular portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a nipple located between the tubing parts and connecting the tubing parts with one another, said fixing means being formed so as to fix said at least one portion of said body to the nipple, and said sealing means being formed so as to seal said at least one portion of said body relative to the nipple.

11. An oil production system, comprising a well tubing; and a device for intensification of oil production, said device including a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one tubular portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a collar connecting the tubing parts with one another, said fixing means of said at least one portion of said body being formed so as to fix said one portion relative to the collar.

12. An oil production system, comprising a well tubing; and a device for intensification of oil production, said device including a substantially tubular hollow body adapted to be arranged inside a well tubing and having an axis and a plurality of passages arranged one after the other in an axial direction and having different dimensions so that oil can flow from a bottomhole of the well successively through said passages toward a well head, said body having at least one tubular portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, the well tubing including an upstream tubing part and a downstream tubing part axially spaced from one another, and a collar connecting the tubing parts with one another, said fixing means of said at least one portion of said body being formed so as to fix said one portion relative to the collar, said sealing means being formed so as to seal said at least one portion of said body relative to the well tubing.

13. An oil production system, comprising a well tubing; and a device for intensification of oil production, said device including a substantially tubular hollow body adapted to be arranged inside a well tubing with a smooth inner surface and having an axis and a plurality of passages arranged one after the other in an axial direction and having different dimensions so that oil can flow from a bottomhole of the well successively through said passages toward a well head, said body having at least one tubular portion which is provided inside with at least one of said passages and is provided outside with means for fixing said at least one portion and therefore said body to the well tubing, said body also having another portion axially spaced from said at least one portion and provided inside with at least one of said passages and outside with means for sealing said another portion relative to the well tubing, said fixing means being formed so as to fix said at least one portion of said body to the smooth inner surface of the well tubing, said sealing means being formed so as to seal said at least one of said portion of said body relative to the smooth inner surface of the well tubing.

14. A device as defined in claim 6, wherein said other portion of said body is located upstream of said one portion as considered in a direction of a flow of oil through said passages of said body.

15. A device as defined in claim 6, wherein said body is composed of at least two body parts including a first body part located upstream of a second body part as considered in a direction of flow of oil through said passages of said body, said fixing means and said sealing means being provided in said second body part.

16. A device as defined in claim 15; and further comprising means for releasaby connecting said first and second body parts with one another.

17. A device as defined in claim 8, wherein said other portion of said body is located upstream of said one portion as considered in a direction of a flow of oil through said passages of said body.

18. A device as defined in claim 8, wherein said body is composed of at least two body parts including a first body part located upstream of a second body part as considered in a direction of flow of oil through said passages of said body, said fixing means and said sealing means being provided in said second body part.

19. A device as defined in claim 18; and further comprising means for releasaby connecting said first and second body parts with one another.

* * * * *